US010925309B2

(12) United States Patent
Gao et al.

(10) Patent No.: US 10,925,309 B2
(45) **Date of Patent: *Feb. 23, 2021**

(54) TOBACCO LOZENGE

(71) Applicant: Altria Client Services LLC, Richmond, VA (US)

(72) Inventors: Feng Gao, Midlothian, VA (US); Diane L. Gee, Chesterfield, VA (US); Shuzhong Zhuang, Glen Allen, VA (US); Phillip M. Hulan, Midlothian, VA (US); William J. Burke, Nashville, TN (US)

(73) Assignee: Altria Client Sendees LLC, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/370,020

(22) Filed: Mar. 29, 2019

(65) Prior Publication Data

US 2019/0223490 A1 Jul. 25, 2019

Related U.S. Application Data

(62) Division of application No. 14/506,003, filed on Oct. 3, 2014, now Pat. No. 10,244,786.

(60) Provisional application No. 61/886,399, filed on Oct. 3, 2013.

(51) Int. Cl.

| | |
|---|---|
| ***A24B 15/10*** | (2006.01) |
| ***A24B 13/00*** | (2006.01) |
| ***A24B 15/18*** | (2006.01) |

(52) U.S. Cl.

CPC ..... *A24B 15/10* (2013.01); *A24B 13/00* (2013.01); *A24B 15/18* (2013.01)

(58) Field of Classification Search

None

See application file for complete search history.

(56) References Cited

U.S. PATENT DOCUMENTS

| | | | |
|---|---|---|---|
| 2,162,738 | A | 6/1939 | McCoy |
| 3,139,436 | A | 6/1964 | Bicking |
| 3,396,735 | A | 8/1968 | Von Bethmann et al. |
| 4,153,063 | A | 5/1979 | Roselius et al. |

(Continued)

FOREIGN PATENT DOCUMENTS

| | | | |
|---|---|---|---|
| DE | 19811167 | A1 | 9/1999 |
| WO | WO-2009/134947 | A1 | 11/2009 |
| WO | WO-2010/044736 | A1 | 4/2010 |

OTHER PUBLICATIONS

Fitzpatrick et al, "Comparing the caking behaviors of skim milk powder, amorphous maltodextrin and crystalline common salt", Powder Tech, v. 204, No. 1, 2010, pp. 131-137.[online], retr from the Internet, [retrieved Mar. 26, 2017], <URL: http://www.sciencedirect.com/science/article/pii/S003259101003761>. (Year: 2010).*

(Continued)

*Primary Examiner* — Dennis R Cordray

(74) *Attorney, Agent, or Firm* — Harness, Dickey & Pierce, P.L.C.

(57) ABSTRACT

A tobacco lozenge includes a body configured to be wholly receivable in an oral cavity. The body includes a matrix including a soluble fiber in an amount greater than or equal to 60 weight percent of the body, tobacco plant tissue dispersed in the matrix, and an additive dispersed in the matrix.

19 Claims, 5 Drawing Sheets

(56) References Cited

U.S. PATENT DOCUMENTS

| | | | | |
|---|---|---|---|---|
| 4,448,208 | A | 5/1984 | Friedrich et al. | |
| 4,516,590 | A | 5/1985 | Teng | |
| 4,528,993 | A | 7/1985 | Sensabaugh, Jr. et al. | |
| 4,647,459 | A | 3/1987 | Peters et al. | |
| 4,660,577 | A | 4/1987 | Sensabaugh et al. | |
| 4,848,373 | A | 7/1989 | Lenkey | |
| 4,987,907 | A | 1/1991 | Townend | |
| 5,236,719 | A | 8/1993 | Meyers et al. | |
| 5,284,163 | A | 2/1994 | Knudsen et al. | |
| 5,372,149 | A | 12/1994 | Roth et al. | |
| 5,380,717 | A | 1/1995 | Ohkuma et al. | |
| 5,410,035 | A | 4/1995 | Wakabayashi et al. | |
| 5,487,792 | A | 1/1996 | King et al. | |
| 5,525,351 | A | 6/1996 | Dam | |
| 5,549,906 | A | 8/1996 | Santus | |
| 6,203,842 | B1 | 3/2001 | Reddy | |
| 7,798,151 | B2 | 9/2010 | Krukonis et al. | |
| 9,351,936 | B2 | 5/2016 | Gao et al. | |
| 9,999,243 | B2 * | 6/2018 | Gao | A24B 13/00 |
| 10,244,786 | B2 * | 4/2019 | Gao | A24B 15/10 |
| 2004/0118422 | A1 | 6/2004 | Lundin et al. | |
| 2005/0053665 | A1 | 3/2005 | Ek et al. | |
| 2005/0123502 | A1 | 6/2005 | Chan et al. | |
| 2005/0178398 | A1 | 8/2005 | Breslin et al. | |
| 2005/0226925 | A1 | 10/2005 | Singh | |
| 2005/0244521 | A1 | 11/2005 | Strickland | |
| 2006/0171994 | A1 | 8/2006 | Dupinay et al. | |
| 2007/0144544 | A1 | 6/2007 | Cai et al. | |
| 2008/0209586 | A1 | 8/2008 | Nielsen et al. | |
| 2009/0293889 | A1 | 12/2009 | Kumar et al. | |
| 2010/0010101 | A1 | 1/2010 | Cherukuri | |
| 2011/0110880 | A1 | 5/2011 | Chen | |
| 2011/0139164 | A1 | 6/2011 | Mua et al. | |
| 2011/0165253 | A1 | 7/2011 | Roehrich | |
| 2011/0200670 | A1 | 8/2011 | Thakkar | |
| 2012/0053108 | A1 | 3/2012 | Glenn, Jr. et al. | |
| 2012/0060854 | A1 | 3/2012 | Chen et al. | |
| 2013/0071476 | A1 | 3/2013 | Cherukuri | |
| 2013/0186417 | A1 | 7/2013 | Gao et al. | |
| 2013/0186418 | A1 | 7/2013 | Gao et al. | |
| 2013/0260150 | A1 | 10/2013 | Grivei et al. | |
| 2015/0020818 | A1 | 1/2015 | Gao et al. | |

OTHER PUBLICATIONS

Avaltroni "Maltodextrin mol wt . . . in aq solns",Carbo. Polymers 58, 2004,323-4,[online],retr from Internet,Mar. 27, 2017,<URL: https://www.researchgate.net/publication/223748654_Maltodextrin_molecular_weight_distribution_influence_on_the_glass_transition_temperature_and_viscosity_in_aqueous_solutions> (Year: 2004).*

Definition of lozenge, The Free Dictionary, 3 pages, 2002, [online], retrieved from the Internet, [retrieved Mar. 30, 2017], <URL: http://www.thefreedictionary.com/lozenge>. (Year: 2002).*

Definition of matrix, The Free Dictionary, 5 pages, 1991 to 2016, [online], retrieved from the Internet, [retrieved Oct. 11, 2017], <URL: http://www.thefreedictionary.com/matrix>. (Year: 1991).*

Tso, 1999, Chapter 1 in Tobacco, Production, Chemistry and Technology, Davis & Nielsen, eds., Blackwell Publishing, Oxford.

International Search Report and Written Opinion in International Application No. PCT/US2014/059148, dated Dec. 12, 2014, 9 pages.

Gonnissen, et al. "Development of Directly Compressible Powders via Co-Spraying," Eur J. Pharma Biopharma 67:220, 2007.

International Preliminary Report on Patentability in International No. PCT/US2014/059148, dated Apr. 14, 2016, 6 pages.

Patel, et al. "Advances in oral transmucosal drug delivery," JControl Release 153(2): 106-116, Jul. 30, 2011.

Definition of matrix, The Free Dictionary, 5 pages, 1991 to 2016, [online], retrieved from the internet, [retrieved Oct. 11, 2017], <URL: http://www.thefreedictionary.com/matrix>.

Fitzpatrick, et al. "Comparing the caking behaviours of skim milk, powder, amorphous maltodextrin and crystalline common salt," Powder Technology, V. 204, No. 1, 2010, pp. 131-137. [online], retrieved from the internet, [retrieved Mar. 26, 2017], <URL: http://www.sciencedirect.com/science/article/pii/S0032591010003761>.

"Particle Size Conversation Table," SIGMA-ALDRICH, 2003-2004, [online], retreieved from the internet, [retreieved Mar. 29, 2017], <URL: http://sigmaaldrich.com/chemistry/stockroom-reagents/learning-ceneter/technical-library/particle-size-conversation.html>.

Avaltroni et al. "Maltodextrin molecular weight distribution influence on the glass transition temperature and viscosity in aqueous solutions" Carbohyd Polymers 58 (2004), 323-334, {online], retrieved front he internet, [retrieved Mar. 27, 2017], <URL: https://www.researchgate.net/publication/223748654_Maltodextrin_molecular_weight_distribution_in.

Definition of lozenge, The Free Dictionary, 3 pp., 2002, online, retrieved from the Internet [retrieved Mar. 30, 2017], <URL: http://www.thefreedictionary.com/lozenge>.

Non-Final Office Action dated Mar. 31, 2017 in U.S. Appl. No. 14/506,002.

Notice of Allowance dated Oct. 17, 2017 in U.S. Appl. No. 14/506,002.

Notice of Allowance dated Feb. 20, 2018 in U.S. Appl. No. 14/506,002.

* cited by examiner

TOBACCO LOZENGE

CROSS REFERENCE TO RELATED APPLICATIONS

This application is a Divisional Application of U.S. application Ser. No. 14/506,003, filed Oct. 3, 2014, which claims the benefit of priority under 35 U.S.C. § 119(e) to U.S. Application No. 61/886,399 filed Oct. 3, 2013, the entire contents of each of which are incorporated herein by reference.

TECHNICAL FIELD

This document relates to tobacco lozenges and methods for making tobacco lozenges. For example, a tobacco lozenge can include tobacco plant tissue within a soluble-fiber matrix (e.g., maltodextrin).

BACKGROUND

Tobacco can be enjoyed by adult tobacco consumers in a variety of forms. Smoking tobacco is combusted and the aerosol either tasted or inhaled (e.g., in a cigarette, cigar, or pipe). Smokeless tobacco products are not combusted and include: chewing tobacco, moist smokeless tobacco, snus, and dry snuff. Chewing tobacco is coarsely divided tobacco leaf that is typically packaged in a large pouch-like package and used in a plug or twist. Moist smokeless tobacco is a moist, more finely divided tobacco that is provided in loose form or in pouch form and is typically packaged in round cans and used as a pinch or in a pouch placed between an adult tobacco consumer's cheek and gum. Snus is a heat treated smokeless tobacco. Dry snuff is finely ground tobacco that is placed in the mouth or used nasally.

SUMMARY

A tobacco lozenge provided herein provides a satisfying tactile and/or flavor experience. A tobacco lozenge provided herein includes a body that is at least partially receivable in an oral cavity of an adult tobacco consumer. In some cases, a tobacco lozenge provided herein includes a body that is wholly receivable in an oral cavity. The body can include a soluble-fiber matrix and tobacco plant tissue dispersed in the soluble-fiber matrix. In some cases, a tobacco lozenge provided herein includes at least 40 weight percent of soluble fiber. In some cases, soluble fiber in tobacco lozenge provided herein can include maltodextrin. A tobacco lozenge provided herein can be adapted to release tobacco plant tissue from the body when the body is received within the oral cavity of an adult tobacco consumer and exposed to saliva. A body of a tobacco lozenge provided herein has the soluble fiber form a matrix around particles of tobacco plant tissue. In some cases, the soluble fiber of a tobacco lozenge provided herein can be amorphous. A tobacco lozenge provided herein can, in some cases, include at least 1 weight percent tobacco plant tissue. A tobacco lozenge provided herein can, in some cases, include 5 weight percent tobacco plant tissue. A tobacco lozenge provided herein can, in some cases, include at least 10 weight percent tobacco plant tissue. A tobacco lozenge provided herein can, in some cases, include 20 weight percent tobacco plant tissue. A tobacco lozenge provided herein can, in some cases, include 30 weight percent tobacco plant tissue. A tobacco lozenge provided herein can, in some cases, include at least 40 weight percent tobacco plant tissue. In some cases, tobacco plant tissue used in a tobacco lozenge provided herein can be processed to have an average particle size of less than 200 micrometers, less than 150 micrometers, less than 125 micrometers, less than 100 micrometers, less than 75 micrometers, less than 50 micrometers, less than 25 micrometers, less than 20 micrometers, or less than 10 micrometers. In some cases, tobacco plant tissue used in a tobacco lozenge provided herein can be processed to have an average particle size of at least 1 micrometer, at least 5 micrometers, at least 10 micrometers, at least 25 micrometers, at least 50 micrometers, at least 75 micrometers, at least 100 micrometers, at least 125 micrometers, or at least 150 micrometers. In some cases, tobacco plant tissue used in a tobacco lozenge provided herein can be processed to have an average particle size of between 25 and 125 micrometers.

A method of making tobacco lozenges provided herein includes forming a molten mixture of at least 40 weight percent soluble fiber, 1 weight percent of tobacco, and less than 15 weight percent water, while maintaining a mixture temperature of less than 200° C., and portioning the molten mixture into a plurality of tobacco lozenges. In some cases, the ingredients can be mixed to form the molten mixture in an extruder, flattened into a sheet of a predetermined thickness as it leaves the extruder, and individual tobacco lozenges cut from the sheet before the sheet cools below the glass transition temperature range of the molten mixture. Unlike a traditional lozenge, which incorporates sugars or sugar alcohols that are heated to a temperature such that caramelization occurs, methods provided herein include heating the molten mixture to form a dispersion of tobacco particles (and optionally other ingredients) in a solution of the soluble fiber and water without significant crosslinking occurring. Because tobacco plant tissue can have negative sensorial characteristics when exposed to temperatures in excess of 200° C. over an extended period of time, a temperature of a molten mixture provided herein can be maintained at a temperature of 200° C. or below. In some cases, a molten mixture provided herein is heated to a temperature of between 80° C. and 200° C. In some cases, a molten mixture provided herein is heated to a temperature of between 100° C. and 110° C. When cooled below its glass transition temperature, a molten mixture provided herein solidifies into an amorphous, non-porous, Soluble fiber matrix containing tobacco particles. Because the soluble fibers do not become crosslinked, the soluble fibers remain soluble and thus dissolve when placed in an adult tobacco consumer's mouth.

A tobacco lozenge body can be rigid and brittle. In some cases, a body provided herein can have a glass transition temperature greater than 37° C. In some cases, a body provided herein can have a glass transition temperature of between 50° C. and 120° C. In some cases, a body provided herein can have a glass transition temperature of between 80° C. and 100° C. A tobacco lozenge provided herein can have a coating over the body. In some cases, the body of a tobacco lozenge provided herein can be non-porous.

A tobacco lozenge body can include at least 40 weight percent of soluble fiber. In some cases, the tobacco lozenge body includes at least 50 weight percent of soluble fiber. In some cases, the tobacco lozenge body includes at least 60 weight percent of soluble fiber. In some cases, the tobacco lozenge body includes at least 70 weight percent of soluble fiber. In some cases, the tobacco lozenge body includes at least 75 weight percent of soluble fiber. In some cases, the tobacco lozenge body includes at least 80 weight percent of soluble fiber. In some cases, the tobacco lozenge body includes at least 85 weight percent of soluble fiber. In some cases, the tobacco lozenge body includes at least 90 weight percent of soluble fiber. In some cases, the tobacco lozenge body includes at least 95% weight percent of soluble fiber. In some cases, the soluble fiber can include maltodextrin, psyllium, inulin, arabinoxylans, cellulose, and many other plant components such as resistant starch, resistant dextrins, lignin, pectins, beta-glucans, and oligosaccharides or a combination thereof. In some cases, a tobacco lozenge body can include at least 40 weight percent maltodextrin. In some cases, the tobacco lozenge body includes at least 50 weight percent maltodextrin. In some cases, the tobacco lozenge body includes at least 60 weight percent maltodextrin. In some cases, the tobacco lozenge body includes at least 70 weight percent maltodextrin. In some cases, the tobacco lozenge body includes at least 75 weight percent maltodextrin. In some cases, the tobacco lozenge body includes at least 80 weight percent maltodextrin. In some cases, the tobacco lozenge body includes at least 85 weight percent maltodextrin. In some cases, the tobacco lozenge body includes at least 90 weight percent maltodextrin. In some cases, the tobacco lozenge body includes at least 95 weight percent maltodextrin.

In some cases, a tobacco lozenge provided herein can include a digestion-resistant soluble fiber. (e.g., maltodextrins,) Suitable maltodextrins include those that are soluble in water up to 70% at 20° C., have a viscosity of about 15 cps for a 30% solution at 30° C., a DE in the range of about 6-16, and contain random α-1,2, α-1,3, α-1,4, β-1,2, β-1,3 and β-1,4 glucose linkages in addition to the normal α-1,4 glucose linkages found in partially hydrolyzed starch. See, e.g., U.S. Pat. Nos. 5,410,035; 5,380,717. For example, Fibersol®-2 is a maltodextrin of DE 6-10 processed from corn starch using hydrochloric acid and enzymes, which can be used as the soluble fiber in a tobacco lozenge provided herein. Fibersol®-2 is partially indigestible because human digestive enzymes are incapable of digesting β1,2, β1,3 and β1,6 glucose bonds. See, e.g., U.S. Pat. No. 6,203,842. Other starch sources such as potato, rice, wheat, barley, peas, beans, lentils, oats, or tapioca can be processed to form digestion-resistant soluble fiber. A digestion resistant soluble fiber includes starch linkages that cannot be hydrolyzed by enzymes of the human digestive tract. Soluble fiber used in a tobacco lozenge provided herein can be a soluble fiber generally recognized as safe ("GRAS") by the Food and Drug Administration or another appropriate private, state, or national regulatory agency.

A tobacco lozenge provided herein can, in some cases, include up to 15 weight percent water. In some cases, a tobacco lozenge provided herein can include between 2 weight percent and 15 weight percent water. In some cases, a tobacco lozenge provided herein can include between 3 weight percent and 10 weight percent water. In some cases, a tobacco lozenge provided herein can include between 4 weight percent and 7 weight percent water.

A tobacco lozenge provided herein can include a sweetener dispersed therein. Suitable sweeteners include saccharine, sucralose, aspartame, acesulfame potassium, and combinations thereof. In some cases, a tobacco lozenge provided herein can be substantially free of sugars and sugar alcohols. For example, a tobacco lozenge can be substantially free of sugars and sugar alcohols, but include non-nutritive sweeteners. In some cases, a tobacco lozenge provided herein can include non-caramelized sugars and/or sugar alcohols in a percentage of no more than 25 weight percent. For example, mannitol and/or sorbitol can be added to reduce the glass transition temperature of a molten mixture provided herein. When included, sugars and sugar alcohols in a molten mixture form a solution with the soluble fiber. Sugars and sugar alcohols can alter the glass transition temperature of a molten mixture provided herein. When cooled below the glass transition temperature, a solution of soluble fiber and sugar alcohols remains an amorphous, single-phase, non-cross-linked structure.

A tobacco lozenge provided herein can include flavorants. The flavorants can be natural or artificial. Flavorants can be selected from the following: licorice, wintergreen, cherry and berry type flavorants, Drambuie, bourbon, scotch, whiskey, spearmint, peppermint, lavender, cinnamon, cardamon, apium graveolents, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ylang ylang, sage, fennel, pimenta, ginger, anise, coriander, coffee, mint oils from a species of the genus Mentha, cocoa, and combinations thereof. Synthetic flavorants can also be used. The particular combination of flavorants can be selected from flavorants that are GRAS in a particular country, such as the United States. Flavorants can also be included in the tobacco lozenge as encapsulated flavorants.

A tobacco lozenge provided herein can include a plasticizer dispersed in the soluble-fiber matrix. For example, the plasticizer can be propylene glycol, triacetin, glycerin, vegetable oil, triglycerides, or a combination thereof.

A body of a tobacco lozenge provided herein can have a variety of different shapes, some of which include disk, shield, heart, rectangle, and square. In some cases, a body of a tobacco lozenge provided herein can have rounded corners. In some cases, the body of the tobacco lozenge can be spherical. According to certain cases, the body can have a length or width of between 1 mm and 25 mm and a thickness of between 1 mm and 25 mm. In some cases, the body can have a length or width of between 5 mm and 15 mm and a thickness of between 2 mm and 5 mm. In some cases, a tobacco lozenge provided herein can include a colorant. For example, a body of a tobacco lozenge provided herein can include titanium dioxide, which can provide the body with a white color. In some cases, a coating on the body can include a colorant.

A method of forming tobacco lozenges can include forming a molten mixture of at least 40 weight percent soluble fiber and less than 15 weight percent water and dispersing tobacco particles within that molten mixture, while maintaining a mixture temperature of less than 130° C. In some cases, the molten mixture includes at less than 13 weight percent, less than 10 weight percent, less than 8 weight percent, less than 7 weight percent, less than 6 weight percent, or less than 5 weight percent water. In some cases, the molten mixture includes at least 3 weight percent, at least 4 weight percent, at least 6 weight percent, or at least 7 weight percent water. In addition to tobacco, water, and soluble fiber (e.g., maltodextrin), a molten mixture provided herein can include one or more additives selected from colorants, sweeteners, flavorants, plasticizers, antioxidants, and combinations thereof. In some cases, the molten mixture is substantially free of sugar alcohols.

In some cases, the molten mixture provided herein is formed in an extruder. The extruder can be a multi-staged extruder having different sections that are heated to different temperatures and/or have different ingredients introduced. In some cases, an extruder provided herein can include multiple stages and can be used in a method provided herein in a process where the maximum temperature in any stage is no more than 200° C. (e.g., no more than 150° C., no more than 130° C., no more than 120° C., no more than 110° C., or no more than 105° C.). In some cases, the molten mixture can be heated to a maximum temperature of greater than the molten mixture's Tg and less than 200° C.

Portioning the molten mixture provided herein can be accomplished using any suitable method. In some cases, the molten mixture can be formed into a sheet of a predetermined thickness as it comes out of the extruder and individual tobacco lozenges cut from the sheet with a stamping die. A method provided herein can further include cooling tobacco lozenges and packaging tobacco lozenges.

The details of one or more embodiments of the subject matter described in this specification are set forth in the accompanying drawings and the description below. Other features, aspects, and advantages of the subject matter will become apparent from the description, the drawings, and the claims.

DETAILED DESCRIPTION

The tobacco lozenges described herein include tobacco plant tissue in a soluble-fiber matrix. Tobacco plant tissue (and optionally additional additives) can be dispersed in the soluble-fiber matrix such tobacco flavor, tobacco particles, and/or various additives are released from the tobacco lozenge as it dissolves when the tobacco lozenge is received within an adult tobacco consumer's oral cavity and exposed to saliva. The tobacco lozenges described herein can provide a favorable additive release profile and tactile experience. In some cases, a tobacco lozenge provided herein includes tobacco plant tissue in solution with soluble fiber of the matrix. As used herein, the term "tobacco plant tissue" refers to processed or non-processed cellulosic parts (e.g., leaves, stems) of a member of the genus Nicotiana, but does not include extracts of tobacco (e.g., tobacco-derived nicotine).

A tobacco lozenge provided herein can take up to 1 hour to dissolve when placed in an adult tobacco consumer's mouth. In some cases, a tobacco lozenge provided herein can take between 1 minute and 30 minutes to dissolve when placed in an adult tobacco consumer's mouth if the adult tobacco consumer does not masticate the tobacco lozenge. In some cases, a tobacco lozenge provided herein can take between 2 minutes and 15 minutes to dissolve when placed in an adult tobacco consumer's mouth if the adult tobacco consumer does not masticate the tobacco lozenge.

In addition to tobacco, sweeteners, and flavorants, the tobacco lozenge can also include fillers, plasticizers, antioxidants, and/or processing aids. Fillers can also be included in the soluble-fiber matrix to alter the texture or pliability of the tobacco lozenge. The soluble-fiber matrix can also include plasticizers (e.g., propylene glycol), which can increase the softness of a tobacco lozenge provided herein. Antioxidants can be used to preserve nicotine in the tobacco lozenge. Processing aids can also be present in the tobacco lozenge and be used to facilitate shaping processes.

Tobacco Lozenge Shapes and Packaging

Figure 1:
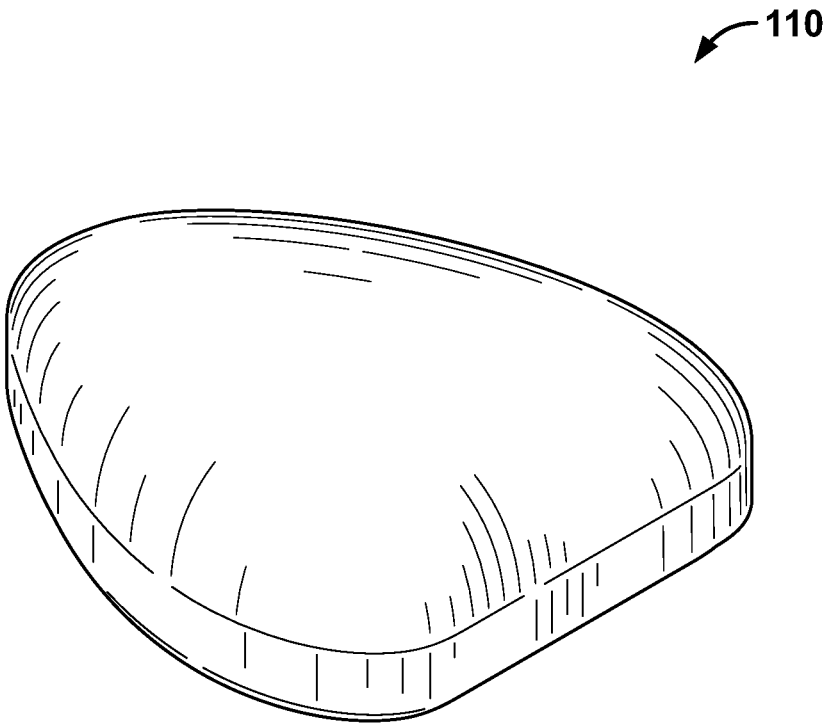
FIG. 1 is a perspective view of an exemplary tobacco lozenge provided herein.

FIG. 1 depicts an example of a tobacco lozenge 110. The tobacco lozenge 110 has a rounded shield shape. For example, the tobacco lozenge 110 can have a diameter of about 16 mm, a width of 14 mm, and a thickness of about 11 mm.

Figure 1A:
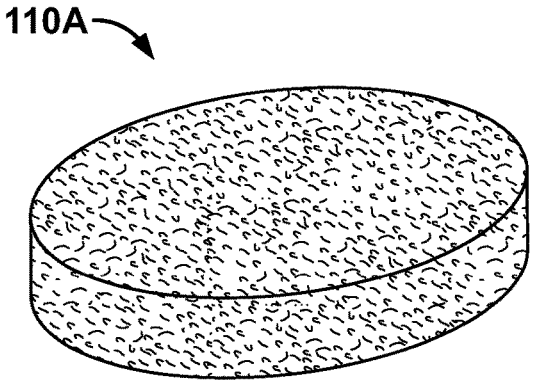
FIGS. 1A-1O illustrates various additional exemplary shapes of tobacco lozenges provided herein.
Figure 1B:
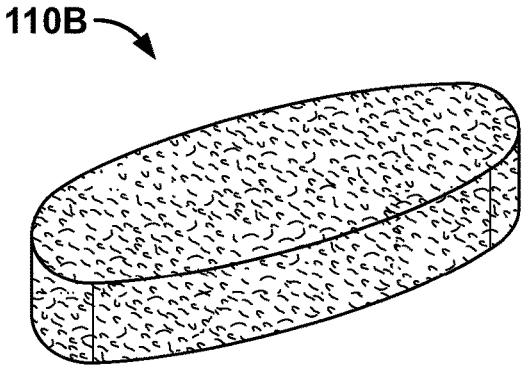
Figure 1C:
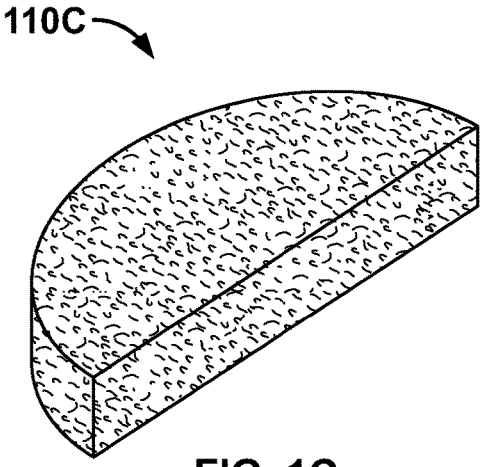
Figure 1D:
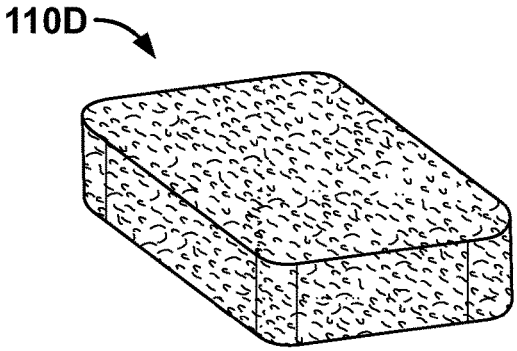
Figure 1E:
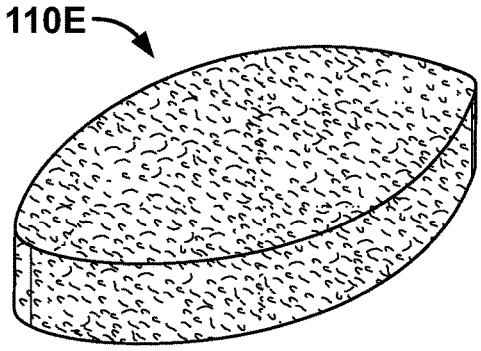
Figure 1F:
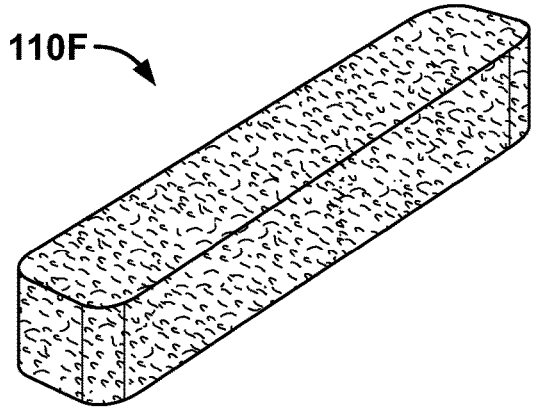
Figure 1G:
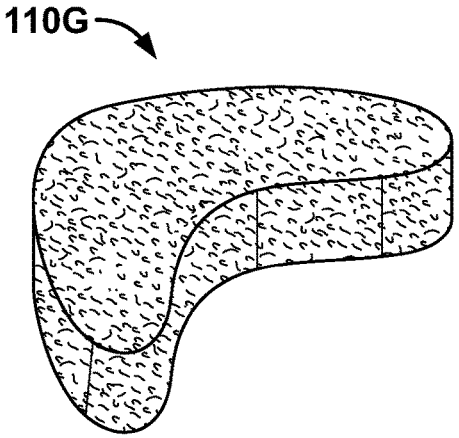
Figure 1H:
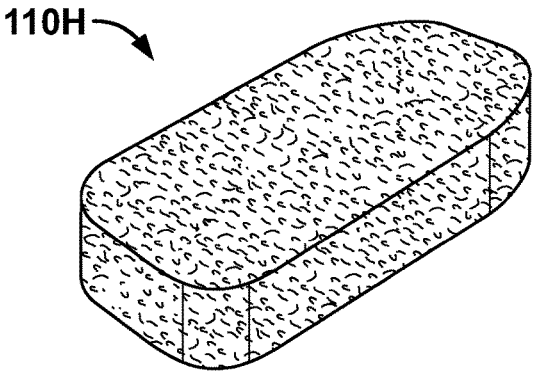
Figure 1I:
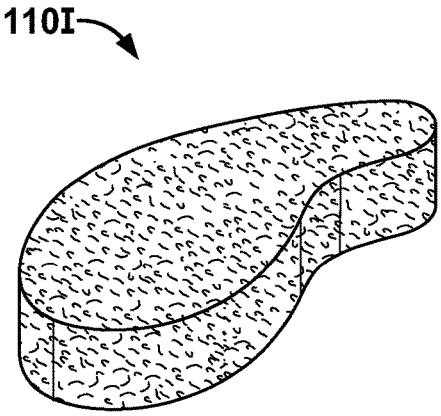
Figure 1J:
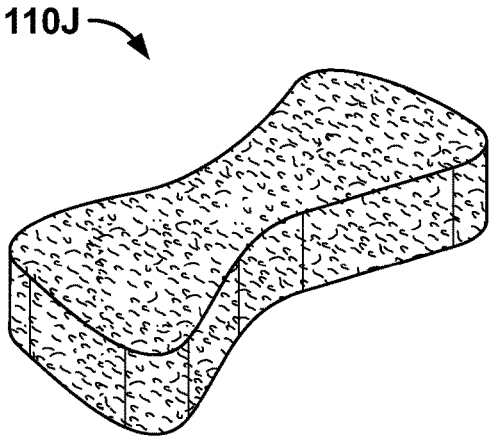
Figure 1K:
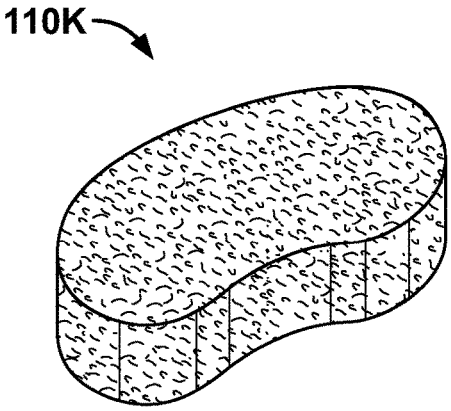
Figure 1L:
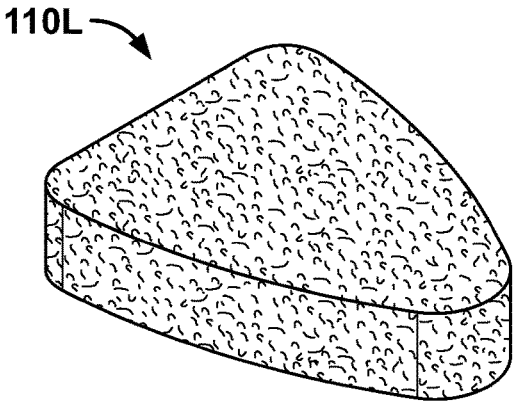
Figure 1M:
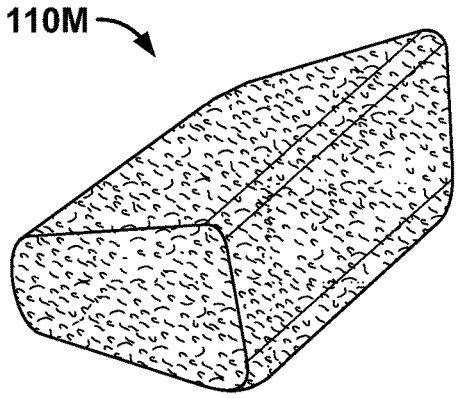
Figure 1N:
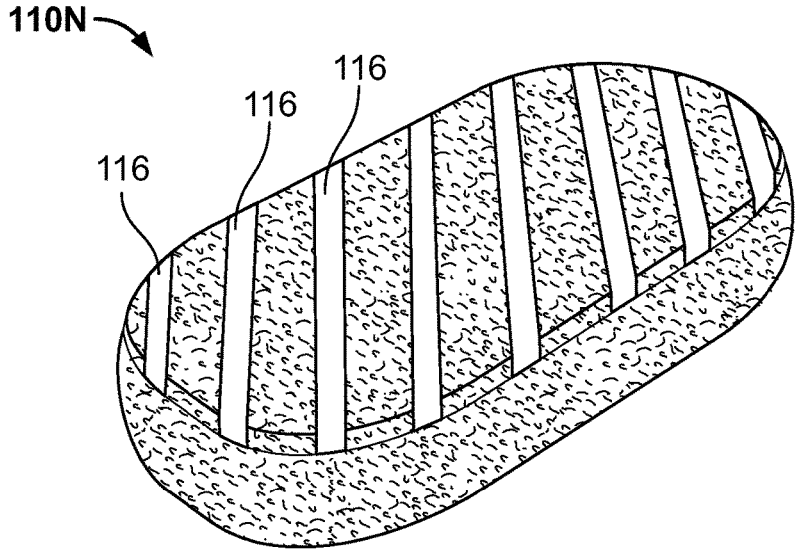

Referring now to FIGS. 1A-1N, the tobacco lozenge 110 can be molded into any desired shape. For example, referring to FIGS. 1A-1L, tobacco lozenges 110A-L can be formed in shape that promotes improved positioning in the oral cavity, improved packaging characteristics, or both. In some circumstances, tobacco lozenges 110A-L can be configured to be: (A) an elliptical-shaped tobacco lozenge 110A; (B) an elongated elliptical-shaped tobacco lozenge 110B; (C) semi-circular tobacco lozenge 110C; (D) square or rectangular-shaped tobacco lozenge 110D; (E) football-shaped tobacco lozenge 110E; (F) elongated rectangular-shaped tobacco lozenge 110F; (G) boomerang-shaped tobacco lozenge 110G; (H) rounded-edge rectangular-shaped tobacco lozenge 110H; (I) teardrop- or comma-shaped tobacco lozenge 110I; (J) bowtie-shaped tobacco lozenge 110J; (K) peanut-shaped tobacco lozenge 110K; and (L) flat shield-shaped tobacco lozenge. Alternatively, the tobacco lozenge can have different thicknesses or dimensionality, such that a beveled article (e.g., a wedge) is produced (see, for example, product 110M depicted in FIG. 1M) or a hemi-spherical shape is produced.

In addition or in the alternative to flavorants being included within the soluble-fiber matrix, flavorants can be included on an exterior of the tobacco lozenge 110. For example, referring to FIG. 1N, for example, some embodiments of a tobacco lozenge 110N can be equipped with flavor strips 116.

Figure 1O:
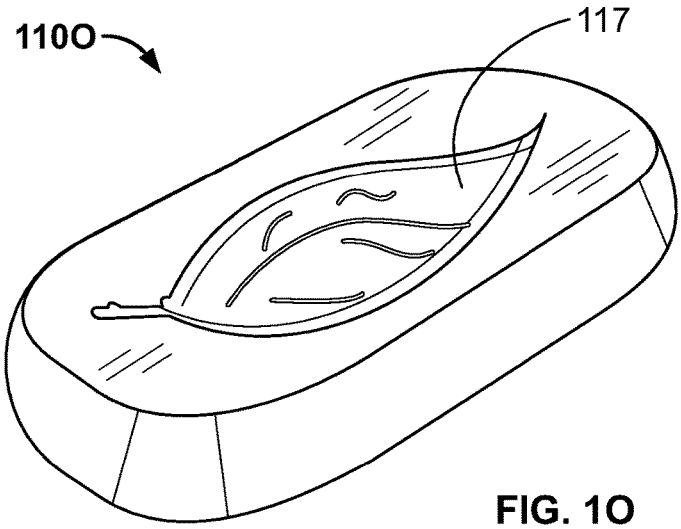

Referring to FIG. 1O, particular embodiments of the tobacco lozenge 110 can be embossed or stamped with a design (e.g., a logo, an image, or the like). For example, the tobacco lozenge 110O can be embossed or stamped with any type of design 117 including, but not limited to, a trademark, a product name, or any type of image. The design 117 can be formed directly into the tobacco lozenge, arranged along the exterior of the product 110O. The design 117 can also be embossed or stamped into those embodiments with a dissolvable film 116 applied thereto.

In some cases, the tobacco lozenge 110 or lozenges 110A-O can be wrapped or coated in an edible or dissolvable film, which may be opaque, substantially transparent, or translucent. The dissolvable film can readily dissipate when the tobacco lozenge 110 is placed in an oral cavity. In some cases, the tobacco lozenge 110 can be coated with a mouth-stable material. Exemplary coating materials include, Carnuba wax, Beeswax, gelatin, acetylated monoglyceride, starch (e.g., native potato starch, high amylose starch, hydroxypropylated potato starch), Zein, Shellac, ethyl cellulose, methylcellulose, hydroxypropyl methylcellulose, carboxymethyl cellulose, and combinations thereof. Additives, such as miglycol, titanium dioxide, kaoline, bentonite, can be incorporated into the coating material to improve oxygen or moisture barrier and mechanical properties for the coating or film. For example, a coating can include a combination of gelatin and methylcellulose or gelatin and hydroxymethylcellulose. In some cases, the coating can contain sugar alcohols such as sorbitol, mannitol, xylitol, erythritol), disaccharide-derived (e.g., isomalt, lactitol, maltitol), or polysaccharide-derived mixtures (e.g., maltitol syrup, hydrogenated starch hydrolysates [HSH]) or combinations thereof. In some cases a coating material can contain sugar alcohols and hydroxymethylcellulose, gelatin, wax, with additives. In some cases, a coating material can include a plasticizer. In some case, a coating can include a colorant, a flavorant, and/or a one or more of the additives discussed above. In some cases, the body of a tobacco lozenge provided herein can have surfaces roughened to improve the adherence of a coating. In some cases, a coating can provide a glossy or semi-glossy appearance, a smooth surface, and/or an appealing visual aesthetic (e.g., a nice color). In some cases, the coating (e.g., a Beeswax, Zein, acetylated monoglyceride, and/or hydroxypropylated potato starch coating) can provide a soft mouth feel. In some cases, the coating (e.g., a methylcellulose, hydroxypropyl methylcellulose, carboxymethyl cellulose, ethyl cellulose, and/or gelatin coating) can provide a hard outer coating.

Tobacco Lozenge Properties

The tobacco lozenge 110 can provide a favorable tactile experience (e.g., mouth feel). The tobacco lozenge 110 can also retain its shape during processing, shipping, handling, and optionally while placed in the mouth. In some cases, the tobacco lozenge 110 can be rigid. In some cases, a tobacco lozenge 110 can be brittle such that an adult tobacco consumer can crunch or masticate the tobacco lozenge 110 in the adult tobacco consumer's mouth. A tobacco lozenge 110 provided herein can be non-porous. Manipulation of a tobacco lozenge 110 provided herein to increase the exposure of surfaces to saliva can accelerate a dissolution rate.

A tobacco lozenge 110 provided herein can have a glass transition temperature (Tg) that is in the range of 50° C. to 120° C. (i.e., about 122° F. to about 248° F.), depending on formulas (e.g. soluble fiber type and weight percentage, water content, total flavor weight percentage, etc.) and processing conditions used to form the tobacco lozenge 110. The Tg can impact the preferred operating temperature used to form a solution of the soluble fiber, tobacco, and other ingredients. By changing the soluble fiber weight percentage and type, the Tg range can be altered. In some cases, when a tobacco lozenge provided herein is placed in an adult tobacco consumer's mouth, the tobacco lozenge is not soft, but remains as an amorphous glassy state, as the adult tobacco consumer's body temperature is below the glass transition temperature range of the product. Tobacco lozenges provided herein can remain in a glassy state throughout the duration of its shelf life (e.g., at least 2 months, at least 6 months, at least 1 year, or at least 2 years). The Tg temperature can also impact a sensorial experience provided by a tobacco lozenge provided herein. For example, a glass transition temperature above body temperature can impede a tobacco lozenge from becoming sticky when placed in the adult tobacco consumers' mouth.

A tobacco lozenge 110 provided herein can have any desirable color. In some cases, a tobacco lozenge 110 provided herein can be translucent and have an off-white color. In some cases, a colorant can be included to provide a desired visual appearance. In some cases, natural and artificial colorants can be added to a soluble-fiber matrix of a tobacco lozenge 110. In some cases, a colorant can make a body of a tobacco lozenge opaque. For example, titanium dioxide can be added to a soluble-fiber matrix to produce an opaque white tobacco lozenge. Encapsulated flavors can be added during the extrusion process to create speckles, patterns or dots within the tobacco lozenge or on a surface of a tobacco lozenge 110. In some cases, a coating applied to a body of a tobacco lozenge can provide a desirable color.

Tobacco lozenges provided herein can have a Tg range of between 50° C. and 120° C. By having a lower limit of the Tg range greater than body temperature (i.e., about 37° C.), tobacco lozenges provided here can remain rigid and non-sticky when placed in an adult tobacco consumer's mouth. A Tg temperature for a particular molten mixture can guide a preferred operating temperature range for the extrusion process. The process is designed to stay well below the decomposition temperature for mixture of ~257° C. A major component for the Tg range is the soluble fiber weight percentage and type. By changing the soluble fiber weight percentage and type, the Tg range can be altered. When a tobacco lozenge provided herein is placed in an adult tobacco consumer's mouth, a tobacco lozenge can remain as an amorphous glassy state, as the adult tobacco consumer's body temperature is below the glass transition temperature range of the tobacco lozenge provided herein. A tobacco lozenge provided herein can be designed to remain in a glassy state throughout the duration of its shelf life for the product. In some cases, a tobacco lozenge provided herein can have a Tg that impacts the sensorial experience. For example, a tobacco lozenge provided herein having a Tg range greater than body temperature can remain non-sticky when placed in an adult tobacco consumer's mouth.

Soluble Fibers

Soluble fiber dissolves in ambient water. Insoluble fiber does not dissolve in ambient water. Soluble fibers can attract water and form a gel. Not only are many soluble fibers safe for consumption, but some soluble fibers are used as a dietary supplement. As a dietary supplement, soluble fiber can slow down digestion and delay the emptying of a stomach. Instead of using soluble fiber as a mere additive, however, tobacco lozenges provided herein include a matrix of soluble fiber, which can dissolve to provide access to nicotine (and optionally other additives) included in the soluble-fiber matrix.

Any suitable soluble fiber or combination of soluble fibers can be used to form a soluble-fiber matrix provided herein. Suitable soluble fibers include maltodextrin, psyllium, pectin, guar gum, gum arabic, inulin, arabinoxylans, cellulose, and many other plant components such as resistant starch, resistant dextrins, lignin, pectins, beta-glucans, and oligosaccharides or a combination thereof. In some cases, a tobacco lozenge provided herein can include a digestion-resistant soluble fiber. A digestion resistant soluble fiber can include starch linkages that remain undigested by enzymes of the human digestive tract. In some cases, a tobacco lozenge provided herein can include a digestion-resistant maltodextrin. Suitable maltodextrins can include those that are soluble in water up to 70% at 20° C., have a viscosity of about 15 cps for a 30% solution at 30° C., a DE in the range of about 6-16, and contain random α-1,2, α-1,3, α-1,4, β-1,2, β-1,3 and β-1,4 glucose linkages in addition to the normal α-1,4 glucose linkages found in partially hydrolyzed starch. See, e.g., U.S. Pat. Nos. 5,410,035; 5,380,717, which are hereby incorporated by reference. For example, Fibersol®-2 is a maltodextrin of DE 6-10 processed from corn starch using hydrochloric acid and enzymes, which can be used as the soluble fiber in a tobacco lozenge provided herein. Fibersol®-2 is partially indigestible because human digestive enzymes are incapable of digesting β1,2, β1,3 and β1,6 glucose bonds. See, e.g., U.S. Pat. No. 6,203,842. In addition to maize, other starch sources such as potato, rice, wheat, barley, peas, beans, lentils, oats, or tapioca can be processed to form digestion-resistant soluble fiber. A digestion resistant soluble fiber includes starch linkages that cannot be hydrolyzed by enzymes of the human digestive tract. In some cases, suitable soluble fibers include Pinefibre, Pinefibre C, Dexflow and Pineflow as discussed in U.S. Pat. No. 5,236,719, which is hereby incorporated by reference. Soluble fiber used in a tobacco lozenge provided herein can be a soluble fiber designated as GRAS by the Food and Drug Administration or another appropriate private, state, or national regulatory agency.

A tobacco lozenge body can include at least 40 weight percent of soluble fiber, at least 50 weight percent of soluble fiber, at least 60 weight percent of soluble, at least 70 weight percent of soluble fiber, at least 75 weight percent of soluble fiber, at least 80 weight percent of soluble fiber, at least 85 weight percent of soluble fiber, at least 90 weight percent of soluble fiber, or at least 90 weight percent of soluble fiber. In some cases, a tobacco lozenge body can include at least 40 weight percent maltodextrin, at least 50 weight percent maltodextrin, at least 60 weight percent maltodextrin, at least 70 weight percent maltodextrin, at least 75 weight percent maltodextrin, at least 80 weight percent maltodextrin, at least 85 weight percent maltodextrin, at least 90 weight percent maltodextrin, or at least 95 weight percent maltodextrin. In some cases, a tobacco lozenge body can include less than 90 weight percent maltodextrin, less than 85 weight percent maltodextrin, or less than 80 weight percent maltodextrin. In some cases, a tobacco lozenge body can include at least 40 weight percent digestion-resistant maltodextrin, at least 50 weight percent digestion-resistant maltodextrin, at least 60 weight percent digestion-resistant maltodextrin, at least 70 weight percent digestion-resistant maltodextrin, at least 75 weight percent digestion-resistant maltodextrin, at least 80 weight percent digestion-resistant maltodextrin, at least 85 weight percent digestion-resistant maltodextrin, at least 90 weight percent digestion-resistant maltodextrin, or at least 95 weight percent digestion-resistant maltodextrin.

Tobacco

Tobacco plant tissue (e.g., tobacco particles) can be dispersed in a matrix of soluble fiber in a tobacco lozenge provided herein. As will be discussed below, tobacco plant tissue (e.g., tobacco particles) can be mixed with the molten mixture of soluble fiber during an extrusion process. Tobacco plant tissue can provide passages in the tobacco lozenge, which can permit certain tobacco constituents and/or additives within the tobacco lozenge to be released into an oral cavity when the tobacco lozenge is received in an oral cavity and exposed to saliva.

Suitable tobaccos include fermented and unfermented tobaccos. In addition to fermentation, the tobacco can be processed using other techniques. For example, tobacco can be processed by heat treatment (e.g., cooking, toasting), flavoring, enzyme treatment, expansion and/or curing. Both fermented and non-fermented tobaccos can be processed using these techniques. In other embodiments, the tobacco can be unprocessed tobacco. Specific examples of suitable processed tobaccos include dark air-cured, dark fire cured, burley, flue cured, and cigar filler or wrapper, as well as the products from the whole leaf stemming operation. In some embodiments, the tobacco fibers includes up to 70% dark tobacco on a fresh weight basis. For example, tobacco can be conditioned by heating, sweating and/or pasteurizing steps as described in U.S. Publication Nos. 2004/0118422 or 2005/0178398. Fermenting typically is characterized by high initial moisture content, heat generation, and a 10 to 20% loss of dry weight. See, e.g., U.S. Pat. Nos. 4,528,993; 4,660,577; 4,848,373; and 5,372,149. In addition to modifying the aroma of the leaf, fermentation can change either or both the color and texture of a leaf. Also during the fermentation process, evolution gases can be produced, oxygen can be taken up, the pH can change, and the amount of water retained can change. See, for example, U.S. Publication No. 2005/0178398 and Tso (1999, Chapter 1 in Tobacco, Production, Chemistry and Technology, Davis & Nielsen, eds., Blackwell Publishing, Oxford). Cured, or cured and fermented tobacco can be further processed (e.g., cut, expanded, blended, milled or comminuted) prior to incorporation into the oral tobacco product. The tobacco, in some embodiments, is long cut fermented cured moist tobacco having an oven volatiles content of between 48 and 50 weight percent prior to mixing with the mouth-stable polymer and optionally flavorants and other additives.

The tobacco can, in some embodiments, be prepared from plants having less than 20 μg of DVT per $cm^2$ of green leaf tissue. For example, the tobacco fibers can be selected from the tobaccos described in U.S. Patent Publication No. 2008/0209586, which is hereby incorporated by reference. Tobacco compositions containing tobacco from such low-DVT varieties exhibits improved flavor characteristics in sensory panel evaluations when compared to tobacco or tobacco compositions that do not have reduced levels of DVTs.

Green leaf tobacco can be cured using conventional means, e.g., flue-cured, barn-cured, fire-cured, air-cured or sun-cured. See, for example, Tso (1999, Chapter 1 in Tobacco, Production, Chemistry and Technology, Davis & Nielsen, eds., Blackwell Publishing, Oxford) for a description of different types of curing methods. Cured tobacco is usually aged in a wooden drum (i.e., a hogshead) or cardboard cartons in compressed conditions for several years (e.g., two to five years), at a moisture content ranging from 10% to about 25%. See, U.S. Pat. Nos. 4,516,590 and 5,372,149. Cured and aged tobacco then can be further processed. Further processing includes conditioning the tobacco under vacuum with or without the introduction of steam at various temperatures, pasteurization, and fermentation. Fermentation typically is characterized by high initial moisture content, heat generation, and a 10 to 20% loss of dry weight. See, e.g., U.S. Pat. Nos. 4,528,993, 4,660,577, 4,848,373, 5,372,149; U.S. Publication No. 2005/0178398; and Tso (1999, Chapter 1 in Tobacco, Production, Chemistry and Technology, Davis & Nielsen, eds., Blackwell Publishing, Oxford). Cure, aged, and fermented tobacco can be further processed (e.g., cut, shredded, expanded, or blended). See, for example, U.S. Pat. Nos. 4,528,993; 4,660,577; and 4,987,907.

Tobacco plant tissue can be processed to a desired size (e.g., a desired particle size). In some cases, the tobacco fiber can be processed to have an average fiber size of less than 200 micrometers, less than 150 micrometers, less than 125 micrometers, less than 100 micrometers, less than 75 micrometers, less than 50 micrometers, less than 25 micrometers, less than 20 micrometers, or less than 10 micrometers. In some cases, tobacco plant tissue used in a tobacco lozenge provided herein can be processed to have an average particle size of at least 1 micrometer, at least 5 micrometers, at least 10 micrometers, at least 25 micrometers, at least 50 micrometers, at least 75 micrometers, at least 100 micrometers, at least 125 micrometers, or at least 150 micrometers. In some cases, tobacco plant tissue used in a tobacco lozenge provided herein can be processed to have an average particle size of between 25 and 125 micrometers. In some embodiments, the tobacco fibers includes long cut tobacco, which can be cut or shredded into widths of about 10 cuts/inch up to about 110 cuts/inch and lengths of about 0.1 inches up to about 1 inch. Double cut tobacco fibers can have a range of particle sizes such that about 70% of the double cut tobacco fibers fall between the mesh sizes of 20 mesh and 80 mesh.

Tobacco plant tissue used in a tobacco lozenge provided herein can have a total oven volatiles content of about 1% by weight or greater; about 20% by weight or greater; about 40% by weight or greater; about 15% by weight to about 25% by weight; about 20% by weight to about 30% by weight; about 30% by weight to about 50% by weight; about 45% by weight to about 65% by weight; or about 50% by weight to about 60% by weight. Those of skill in the art will appreciate that "moist" tobacco typically refers to tobacco that has an oven volatiles content of between about 40% by weight and about 60% by weight (e.g., about 45% by weight to about 55% by weight, or about 50% by weight). As used herein, "oven volatiles" are determined by calculating the percentage of weight loss for a sample after drying the sample in a pre-warmed forced draft oven at 110° C. for 3.25 hours. The tobacco lozenge can have a different overall oven volatiles content than the oven volatiles content of the tobacco fibers used to make the oral tobacco product. The processing steps described herein can reduce or increase the oven volatiles content.

Additives

A variety of additives other than tobacco can be included in a tobacco lozenge provided herein. The additives can include non-nicotine alkaloids, minerals, vitamins, dietary supplements, nutraceuticals, energizing agents, soothing agents, coloring agents, amino acids, chemsthetic agent, antioxidants, food grade emulsifiers, pH modifiers, botanicals (e.g., green tea), teeth whitening (e.g., SHMP), therapeutic agents, sweeteners, flavorants, salt, flavor enhancers, and combinations thereof. In some cases, the additives can further include one or more non-nutritive sweeteners, one or more antioxidants, and one or more flavorants. With certain combinations of tobacco, sweeteners, and flavorants, a tobacco lozenge provided herein may provide a flavor profile and tactile experience similar to certain tobacco products.

Antioxidants

A tobacco lozenge 110 can include one or more antioxidants. Antioxidants can result in a significant reduction in the conversion of nicotine into nicotine-N-oxide when compared to nicotine products without antioxidants. In some cases, a tobacco lozenge provided herein can include 0.01 and 5.00 weight percent antioxidant, between 0.05 and 1.0 weight percent antioxidant, between 0.10 and 0.75 weigh percent antioxidant, or between 0.15 and 0.5 weight percent antioxidant. Suitable examples of antioxidants include ascorbyl palmitate (a vitamin C ester), BHT, ascorbic acid (Vitamin C), and sodium ascorbate (Vitamin C salt). In some cases, monosterol citrate, tocopherols, propyl gallate, tertiary butylhydroquinone (TBHQ), butylated hydroxyanisole (BHA), Vitamin E, or a derivative thereof can be used as the antioxidant. For example, ascorbyl palmitate can be the antioxidant in the formulations listed in Table I. Antioxidants can be incorporated into the soluble-fiber matrix (e.g., maltodextrin) during a mixing process (e.g., added to an extruder mixing the ingredients).

Sweeteners

A variety of synthetic and/or natural sweeteners can be used as additives in a tobacco lozenge 110 provided herein Suitable natural sweeteners include sugars, for example, monosaccharides, disaccharides, and/or polysaccharide sugars, and/or mixtures of two or more sugars. In some cases, a tobacco lozenge 110 provided herein includes one or more of the following: sucrose or table sugar; honey or a mixture of low molecular weight sugars not including sucrose; glucose or grape sugar or corn sugar or dextrose; molasses; corn sweetener; corn syrup or glucose syrup; fructose or fruit sugar; lactose or milk sugar; maltose or malt sugar or maltobiose; sorghum syrup; mannitol or manna sugar; sorbitol or d-sorbite or d-sobitol; fruit juice concentrate; and/or mixtures or blends of one or more of these ingredients. A tobacco lozenge provided herein an also include non-nutritive sweeteners. Suitable non-nutritive sweeteners include: stevia, saccharin; aspartame; sucralose; or acesulfame potassium.

Flavorants

The tobacco lozenge provided herein can optionally include one or more flavorants. The flavorants can be natural or artificial. For example, suitable flavorants include wintergreen, cherry and berry type flavorants, various liqueurs and liquors (such as Dramboui, bourbon, scotch, and whiskey) spearmint, peppermint, lavender, cinnamon, cardamon, apium graveolents, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ylang ylang, sage, fennel, pimenta, ginger, anise, chai, coriander, coffee, liquorish, and mint oils from a species of the genus Mentha, and encapsulated flavors. Mint oils useful in particular embodiments of a tobacco lozenge 110 provided herein include spearmint and peppermint. Synthetic flavorants can also be used. In some cases, a combination of flavorants can be combined to imitate a tobacco flavor. The particular combination of flavorants can be selected from flavorants that are GRAS in a particular country, such as the United States. Flavorants can also be included in the tobacco lozenge as encapsulated flavorants.

In some cases, the flavorants in a tobacco lozenge provided herein are limited to less than 20 weight percent in sum. In some cases, the flavorants in the tobacco lozenge 110 are limited to be less than 10 weight percent in sum. For example, certain flavorants can be included in the tobacco lozenge 110 in amounts of about 1 weight percent to 5 weight percent.

Other Additives

A tobacco lozenge provided herein may optionally include other additives. For example, these additives can include non-nicotine alkaloids, dietary minerals, vitamins, dietary supplements, therapeutic agents, and fillers. For example, suitable vitamins include Vitamins A, B1, B2, B6, C, D2, D3, E, F, and K. For example, a tobacco lozenge 110 provided herein can include C-vitamins. Suitable dietary minerals include calcium (as carbonate, citrate, etc.) or magnesium (as oxide, etc.), chromium (usually as picolinate), and iron (as bis-glycinate). One or more dietary minerals could be included in a tobacco lozenge with or without the use of other additives. Other dietary supplements and/or therapeutic agents can also be included as additives.

A tobacco lozenge provided herein can also include fillers such as starch, di-calcium phosphate, lactose, sorbitol, mannitol, and microcrystalline cellulose, calcium carbonate, dicalcium phosphate, calcium sulfate, clays, silica, glass particles, sodium lauryl sulfate (SLS), glyceryl palmitostearate, sodium benzoate, sodium stearyl fumarate, talc, stearates (e.g., Mg or K), waxes (e.g., glycerol monostearate, propylene glycol monostearate, and acetylated monoglycerides), stabilizers (e.g., ascorbic acid and monosterol citrate, BHT, or BHA), disintegrating agents (e.g., starch, sodium starch glycolate, cross caramellose, crosslinked PVP), pH stabilizers, or preservatives. In some cases, the amount of filler in the tobacco lozenge 110 is limited to less than 10 weight percent in sum. In some cases, the amount of filler in the tobacco lozenge 110 is limited to be less than 5 weight percent in sum. In some cases, the fillers are mouth stable. In some cases, the fillers can dissolve or disintegrate during use and thus result in a tobacco lozenge that becomes more pliable during use.

Plasticizers

A tobacco lozenge 110 provided herein can also include one or more plasticizers. Plasticizers can soften the final tobacco lozenge and thus increase its flexibility. Suitable plasticizers include propylene glycol, triacetin, glycerin, vegetable oil, partially hydrogenated oil, and medium chain triglycerides. Esters of polycarboxylic acids with linear or branched aliphatic alcohols of moderate chain length can also be used as plasticizers. Moreover, plasticizers can facilitate the extrusion processes described below. In some cases, a tobacco lozenge 110 provided herein can include up to 20 weight percent plasticizer. In some cases, the tobacco lozenge 110 includes between 0.05 and 10 weight percent plasticizer, a tobacco lozenge 110 provided herein can include between 1 and 8 weight percent plasticizer, or between 2 and 4 weight percent plasticizer.

PRODUCTION AND EXAMPLE

The tobacco lozenge 110 can be produced by forming a molten mixture of soluble fiber, water, and tobacco under controlled heating conditions such that a solution of soluble fiber and water is formed with tobacco particles in the soluble fiber solution without degrading the tobacco or the soluble fiber. In some cases, a temperature of the molten mixture is maintained for a period of time at a temperature below 200° C. over a residence time of five to ten minutes or less during the mixing. The molten mixture is then portioned into individual tobacco lozenges. Unlike many traditional lozenges, sugar and sugar alcohols are not required to obtain a firm smooth-dissolving texture in processes provided herein. Traditional lozenges can rely on the cross-linking of sugars or sugar alcohols due to caramelization caused by heating to caramelization temperatures. Caramelization temperatures, however, can change the sensorial characteristics of tobacco. A soluble-fiber matrix, however, can provide a tobacco lozenge provided herein with a suitable dissolution time when placed in an adult tobacco consumer's mouth.

A molten mixture can be mixed and heated in any suitable but controlled method. In some cases, ingredients for a molten mixture can be combined in an extruder and mixed in a continuous extrusion process. Unlike a traditional cooking method for many typical lozenges, a tobacco lozenge provided herein can have attributes precisely controlled by extruder operation parameters, such as feed rate, barrel temperature profile, screw design, rpms, etc.

Figure 2:
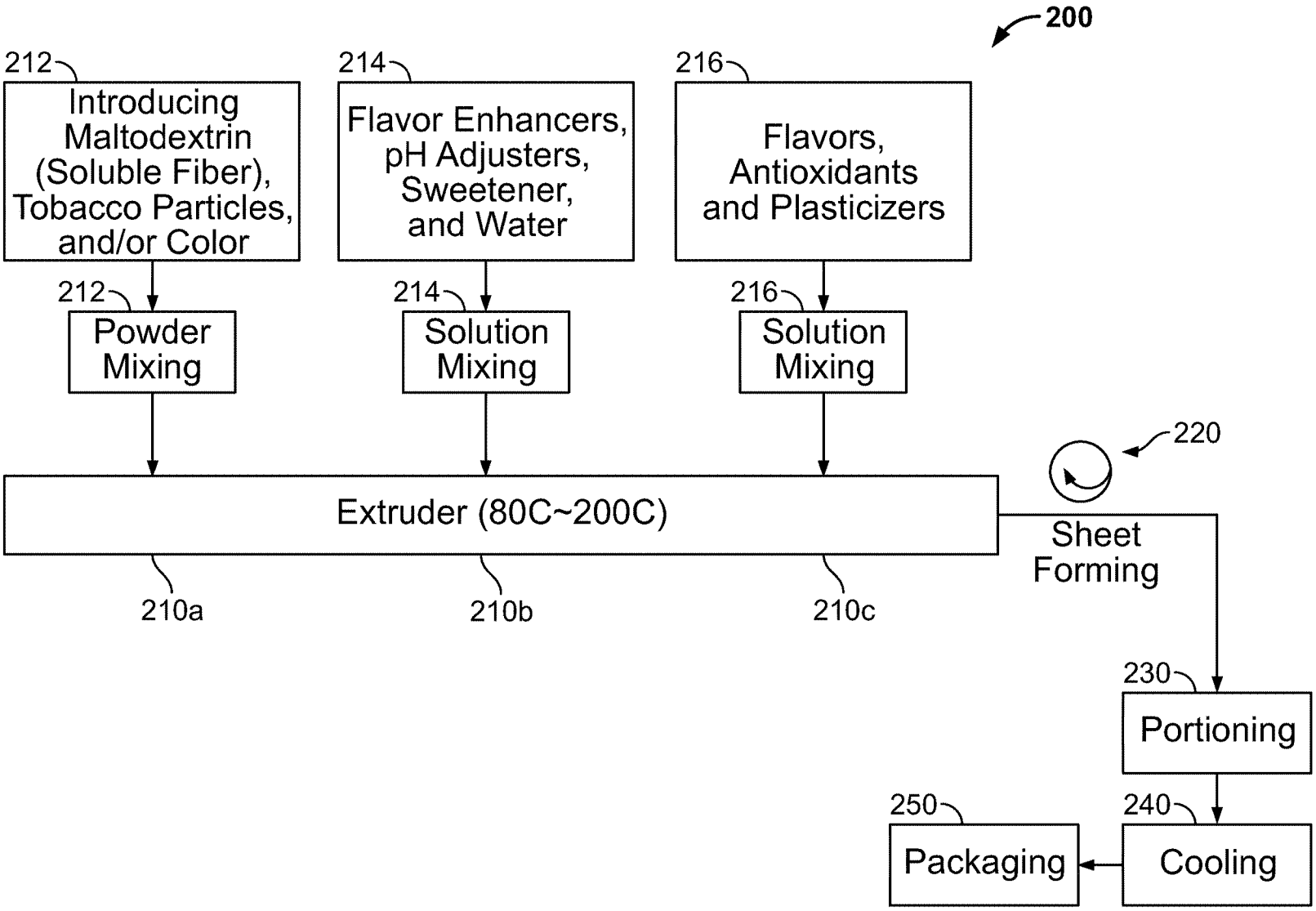
FIG. 2 depicts an exemplary process flow diagram for making tobacco lozenges provided herein.

Referring to FIG. 2, an exemplary method 200 for making tobacco lozenges provided herein can include adding dry ingredients 212 of soluble fiber (e.g., maltodextrin), tobacco, and color (e.g., $TiO_2$) to a first station 210*a* of an extruder 210, adding a first group of solution ingredients 214, including water, sweetener, pH adjusters, and flavor enhancers, at a second station 210*b*, and adding a second group of solution ingredients 216, at a third station 210*c*. A mixing extruder 210 can include multiple stages controlled to be maintained at a predetermined temperature over a residence time of five to ten minutes or less during the mixing. As shown, extruder 210 can include stages having temperatures ranging between 80° C. and 200° C. For example, dry ingredients 212 and first group of solution ingredients 214 can be mixed in a first stage of extruder 210 at a temperature of between 100° C. and 120° C., and one or more subsequent stages can have a higher temperature (e.g., between 120° C. and 200° C.). Second group of ingredients 216, including tobacco, can be added downstream of the mixture of water with the soluble fiber. Adding certain ingredients downstream can limit degradation of certain ingredients (e.g., flavors) due to exposure to heat. A glass transition temperature (Tg) of molten mixture used to make a tobacco lozenge provided herein can range from 50° C. to 120° C. (i.e., about 122° F. to about 248° F.).

A water content of a tobacco lozenge provided herein can be controlled in the extrusion process to ensure that the molten mixture has a glass transition temperature of greater than human body temperature. In some cases, a molten mixture can have a water content of less than 15 weight percent. In some cases, water content in a tobacco lozenge provided herein ranges from 2 weight percent to 15 weight percent. In some cases, water content in a tobacco lozenge provided herein ranges from 2 weight percent to 10 weight percent.

After passing through the extruder, a molten mixture provided herein can have a temperature of between its glass transition temperature and 200° C. In some cases, a molten mixture of between 85 and 95 weight percent digestion-resistant maltodextrin can reach a maximum temperature in an extruder of between 80° C. and 200° C. and exit the extruder at that temperature. Because a molten mixture can remain above its glass transition temperature as it exits the extruder, the molten mixture can be reshaped after it exits the extruder. Molten mixture can pass onto a conveyor and move through a sheet forming apparatus 220. Sheet forming apparatus 220 can press the molten mixture into a sheet having a predetermined thickness. For example, a predetermined thickness can be between 1 mm and 25 mm.

Individual tobacco lozenges 110 can be cut from a sheet of molten mixture in portioning station 230. In some cases, a stamping die can cut one or more individual tobacco lozenges 110 to form a sheet. In some cases, a stamping die can press one or both sides of a sheet to both cut a tobacco lozenge and reshape edges to form rounded edges on the tobacco lozenges, such as those shown in FIG. 1. Cutting individual tobacco lozenges 110 can occur when the molten mixture is still above its Tg. Individual tobacco lozenges 110 can be cooled in a cooling station 240 and packaged in a packaging station 250.

In addition to extrusion, there are other methods for mixing and carefully controlling the temperature of a molten mixture used to form tobacco lozenges provided herein.

Other Embodiments

It is to be understood that, while the invention has been described herein in conjunction with a number of different aspects, the foregoing description of the various aspects is intended to illustrate and not limit the scope of the invention, which is defined by the scope of the appended claims. Other aspects, advantages, and modifications are within the scope of the following claims.

Disclosed are methods and compositions that can be used for, can be used in conjunction with, can be used in preparation for, or are products of the disclosed methods and compositions. These and other materials are disclosed herein, and it is understood that combinations, subsets, interactions, groups, etc. of these methods and compositions are disclosed. That is, while specific reference to each various individual and collective combinations and permutations of these compositions and methods may not be explicitly disclosed, each is specifically contemplated and described herein. For example, if a particular composition of matter or a particular method is disclosed and discussed and a number of compositions or methods are discussed, each and every combination and permutation of the compositions and the methods are specifically contemplated unless specifically indicated to the contrary. Likewise, any subset or combination of these is also specifically contemplated and disclosed.

What is claimed is:

1. A tobacco lozenge comprising:

a body configured to be wholly receivable in an oral cavity, the body including, a matrix comprising a soluble fiber in an amount greater than or equal to 95 weight percent of the body, tobacco plant tissue dispersed in the matrix, and an additive dispersed in the matrix.

2. The tobacco lozenge of claim 1, wherein the additive comprises a mineral, a vitamin, a dietary supplement, a nutraceutical, an energizing agent, a soothing agent, an amino acid, a chemesthetic agent, an antioxidant, a botanical, a teeth whitening agent, a therapeutic agent, a sub-combination thereof, or a combination thereof.

3. The tobacco lozenge of claim 1, wherein the additive comprises a flavorant dispersed in the matrix.

4. The tobacco lozenge of claim 3, wherein the flavorant comprises licorice, wintergreen, cherry and berry type flavorants, Drambuie, bourbon, scotch, whiskey, spearmint, peppermint, lavender, cinnamon, cardamon, apium graveolens, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ylang-ylang, sage, fennel, pimenta, ginger, anise, coriander, coffee, a mint oil from a species of the genus Mentha, a sub-combination thereof, or a combination thereof.

5. The tobacco lozenge of claim 1, wherein the additive comprises a sweetener.

6. The tobacco lozenge of claim 1, further comprising:

a coating on at least a portion of a surface of the body.

7. The tobacco lozenge of claim 1, wherein the body further comprises a plasticizer.

8. The tobacco lozenge of claim 1, wherein the body is non-porous.

9. The tobacco lozenge of claim 1, wherein the body further comprises a colorant.

10. The tobacco lozenge of claim 1, wherein the body has a glass transition temperature of greater than or equal to 37° C.

11. The tobacco lozenge of claim 10, wherein the body has a glass transition temperature ranging from 50° C. to 120° C.

12. The tobacco lozenge of claim 1, wherein the matrix is amorphous.

13. The tobacco lozenge of claim 1, wherein the body is substantially free of sugar and sugar alcohols.

14. The tobacco lozenge of claim 1, wherein the tobacco plant tissue is present in an amount greater than or equal to 1 weight percent of the body.

15. The tobacco lozenge of claim 1, wherein the soluble fiber comprises maltodextrins, psyllium, inulin, arabinoxylans, cellulose, resistant starch, resistant dextrins, lignin, pectins, beta-glucans, oligosaccharides, a sub-combination thereof, or a combination thereof.

16. A tobacco lozenge comprising:

a body configured to be wholly receivable in an oral cavity, the body being amorphous, substantially free of sugar and sugar alcohols, and having a glass transition temperature of 50° C. to 120° C., the body including, a matrix comprising a soluble fiber in an amount greater than or equal to 95 weight percent of the body, the matrix being amorphous, tobacco plant tissue dispersed in the matrix, the tobacco plant tissue being present at greater than or equal to 1 weight percent of the body, and an additive dispersed in the matrix.

17. A tobacco lozenge comprising:

a body configured to be wholly receivable in an oral cavity, the body including, a matrix comprising a soluble fiber in an amount greater than or equal to 95 weight percent of the body, and tobacco plant tissue dispersed in the matrix.

18. The tobacco lozenge of claim 17, wherein the body is amorphous, the body is substantially free of sugar alcohols, and the body has a glass transition temperature of 50° C. to 120° C.

19. The tobacco lozenge of claim 17, wherein the tobacco plant tissue is present in the body in an amount greater than or equal to 1 weight percent.

* * * * *